US009578925B1

(12) United States Patent
Michel et al.

(10) Patent No.: US 9,578,925 B1
(45) Date of Patent: Feb. 28, 2017

(54) WATERPROOF FOOTWEAR POCKET

(71) Applicants: Joseph B. Michel, Gloucester City, NJ (US); Rosa Medley, Gloucester City, NJ (US)

(72) Inventors: Joseph B. Michel, Gloucester City, NJ (US); Rosa Medley, Gloucester City, NJ (US)

( * ) Notice: Subject to any disclaimer, the term of this patent is extended or adjusted under 35 U.S.C. 154(b) by 227 days.

(21) Appl. No.: 14/219,228

(22) Filed: Mar. 19, 2014

Related U.S. Application Data

(60) Provisional application No. 61/804,826, filed on Mar. 25, 2013.

(51) Int. Cl.
*A43B 3/00* (2006.01)
*A43B 23/24* (2006.01)

(52) U.S. Cl.
CPC ..... *A43B 23/24* (2013.01); *A43B 3/0031* (2013.01)

(58) Field of Classification Search
CPC ..... A43B 3/0031; A43B 23/24; A43C 19/00
USPC ..... 36/136; D2/972
See application file for complete search history.

(56) References Cited

U.S. PATENT DOCUMENTS 1,289,341 A * 12/1918 Wirsching ..... A43B 3/0031 36/1
4,280,287 A * 7/1981 Gulbransen ..... A43B 23/025 36/114
4,296,559 A * 10/1981 Gamm ..... A43B 3/0031 36/136
4,384,414 A * 5/1983 Gamm ..... A43B 3/0031 2/252
4,547,982 A * 10/1985 Gamm ..... A43B 3/0031 36/114
4,611,416 A * 9/1986 Lin ..... A43B 1/0072 2/245
4,612,714 A * 9/1986 Gamm ..... A43B 3/0031 36/114
4,638,579 A * 1/1987 Gamm ..... A43B 3/0031 2/247
4,955,150 A * 9/1990 Fagan ..... A43B 1/0072 36/136
D378,010 S * 2/1997 Isenberg ..... D2/946
D404,546 S * 1/1999 Isenberg ..... D2/905
5,970,633 A * 10/1999 Jones ..... A43B 1/0036 36/136
D506,596 S * 6/2005 Kim ..... D2/905
(Continued)

*Primary Examiner* — Marie Bays
(74) *Attorney, Agent, or Firm* — Quickpatents, LLC; Kevin Prince

(57) ABSTRACT

A waterproof footwear pocket which protects various small items from exposure to water while being secured in a pocket on a shoe. The waterproof footwear pocket generally includes footwear having a water-proof pocket positioned along an outer surface thereof. The pocket includes a main body having an opening leading to an internal cavity. A closure member is provided to selectively open or close the opening so that an object may be positioned therein. The closure member may include a sealant to further prevent water incursion. A flap is provided which may be selectively lowered over the main body of the pocket to cover the opening. Using the present invention, an object such as a key fob may be safely protected from water damage by being placed within the pocket when activities such as water sports which carry a high risk of water exposure are being performed.

19 Claims, 6 Drawing Sheets

(56) References Cited

U.S. PATENT DOCUMENTS

| | | | | |
|---|---|---|---|---|
| 7,758,242 | B2 * | 7/2010 | May | A44B 19/16<br>24/585.12 |
| 2004/0066990 | A1 * | 4/2004 | Schneider | B31B 19/90<br>383/204 |
| 2008/0022558 | A1 * | 1/2008 | Kaufer | A43B 3/0031<br>36/100 |
| 2009/0297817 | A1 * | 12/2009 | Olajide, Jr. | B32B 27/32<br>428/223 |
| 2012/0110873 | A1 * | 5/2012 | Chen | A43B 1/0072<br>36/136 |
| 2012/0171912 | A1 * | 7/2012 | Ewing | B63C 9/11<br>441/106 |

* cited by examiner

WATERPROOF FOOTWEAR POCKET

CROSS REFERENCE TO RELATED APPLICATIONS

I hereby claim benefit under Title 35, United States Code, Section 119(e) of U.S. provisional patent application Ser. No. 61/804,826 filed Mar. 25, 2013. The 61/804,826 application is hereby incorporated by reference into this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to a pocket for footwear and more specifically it relates to a waterproof footwear pocket which protects various small items from exposure to water while being secured in a pocket on a shoe.

Description of the Related Art

Any discussion of the related art throughout the specification should in no way be considered as an admission that such related art is widely known or forms part of common general knowledge in the field.

Protecting one's valuables from exposure to water is increasingly important in recent times, particularly due to the ever-increasing presence of various electronic devices in the average life. When performing activities which one could reasonably expect would risk exposure to water, one is often either required to leave small valuables (such as keys or a cell phone) in a locker or other location where they could be exposed to theft. Alternatively, one is forced to risk bringing such valuables along to such activities with the understanding that there is a risk of such valuables being exposed to water.

Because of the inherent problems with the related art, there is a need for a new and improved waterproof footwear pocket which protects various small items from exposure to water while being secured in a pocket on a shoe.

BRIEF SUMMARY OF THE INVENTION

The invention generally relates to a waterproof pocket for footwear which includes footwear having a water-proof pocket positioned along an outer surface thereof. The pocket includes a main body having an opening leading to an internal cavity. A closure member is provided to selectively open or close the opening so that an object may be positioned therein. The closure member may include a sealant to further prevent water incursion. A flap is provided which may be selectively lowered over the main body of the pocket to cover the opening. Using the present invention, an object such as a key fob may be safely protected from water damage by being placed within the pocket when activities such as water sports which carry a high risk of water exposure are being performed.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
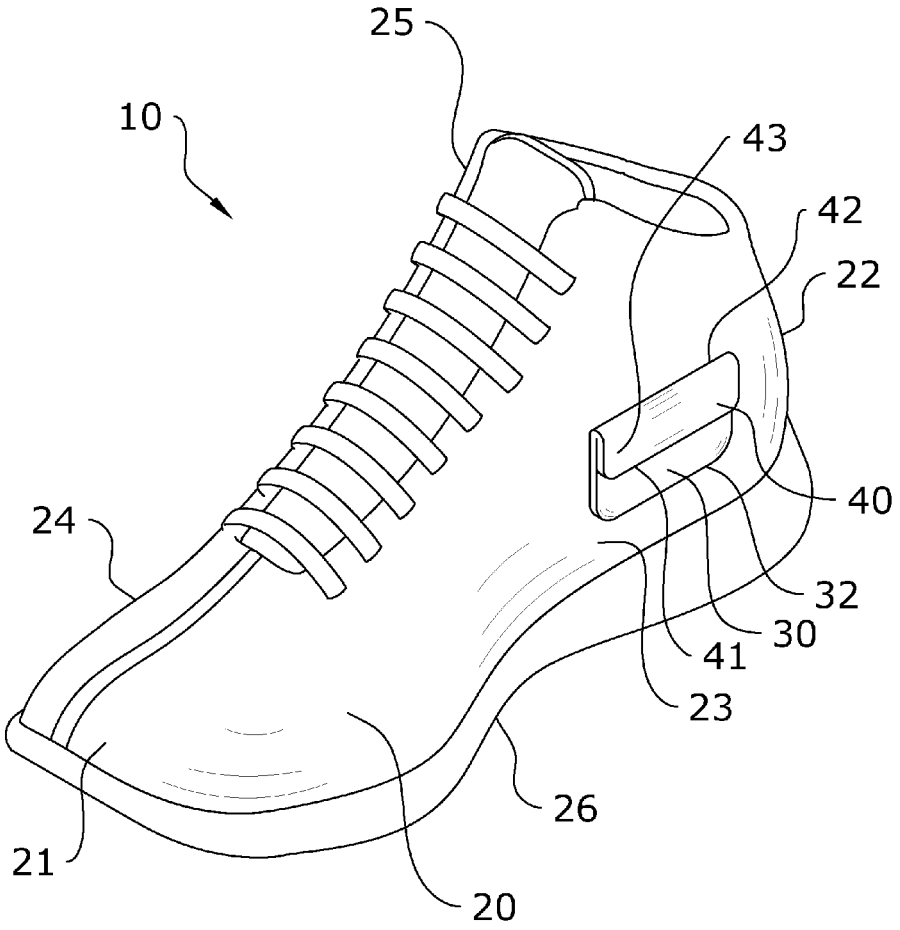
FIG. 1 is an upper perspective view of the present invention with the flap in a closed state incorporated with a first type of footwear.

A. Overview.

Turning now descriptively to the drawings, in which similar reference characters denote similar elements throughout the several views, FIGS. 1 through 6 illustrate a waterproof footwear pocket 10, which comprises footwear 20 having a water-proof pocket 30 positioned along an outer surface thereof. The pocket 30 includes a main body 32 having an opening 33 leading to an internal cavity 34. A closure member 37 is provided to selectively open or close the opening 33 so that an object may be positioned therein. The closure member 37 may include a sealant to further prevent water incursion. A flap 40 is provided which may be selectively lowered over the main body 32 of the pocket 30 to cover the opening 33. Using the present invention, an object such as a key fob may be safely protected from water damage by being placed within the pocket 30 when activities such as water sports which carry a high risk of water exposure are being performed.

B. Footwear.

The present invention is adapted for use with a wide range of types of footwear 20. The present invention may be utilized with footwear 20 which is conventionally meant for water use, such as swimming shoes, sandals, and the like. The present invention may also be utilized with footwear 20 which is not conventionally meant for water use, such as sneakers, pumps, and the like. In any case, the present invention is included to protect various small items (such as a key fob) from exposure to water through either water sports or routine day-to-day travel (such as puddles or heavy rain).

Figure 2:
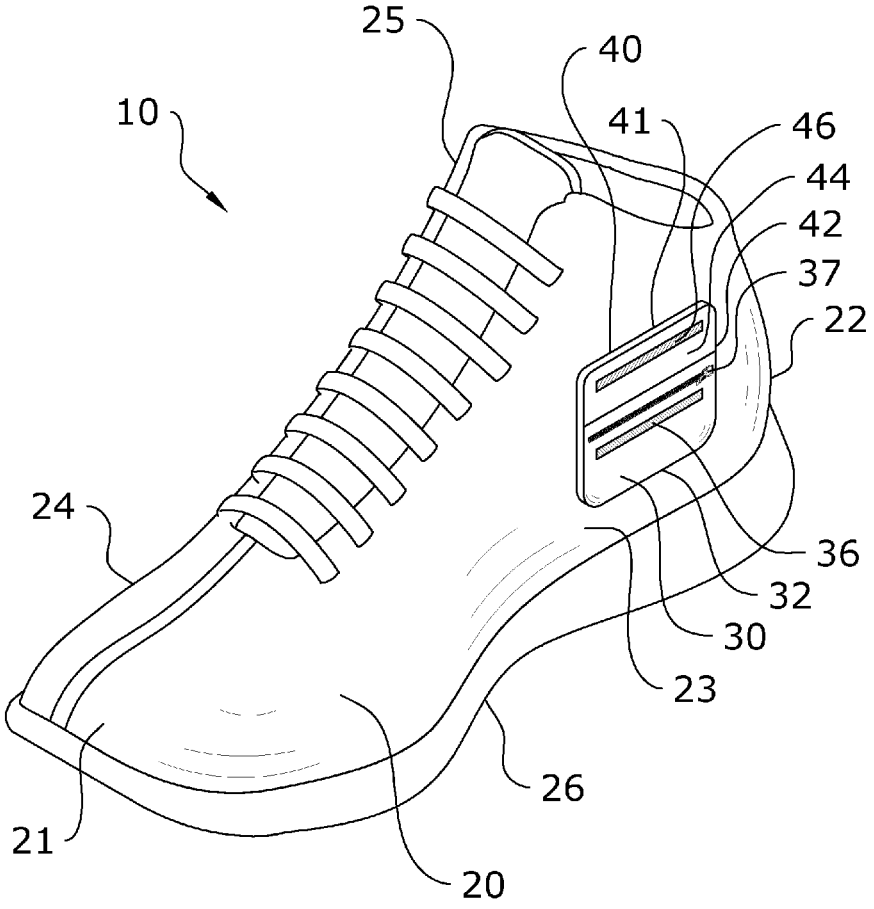
FIG. 2 is an upper perspective view of the present invention with the flap in an opened state incorporated with a first type of footwear.
Figure 3:
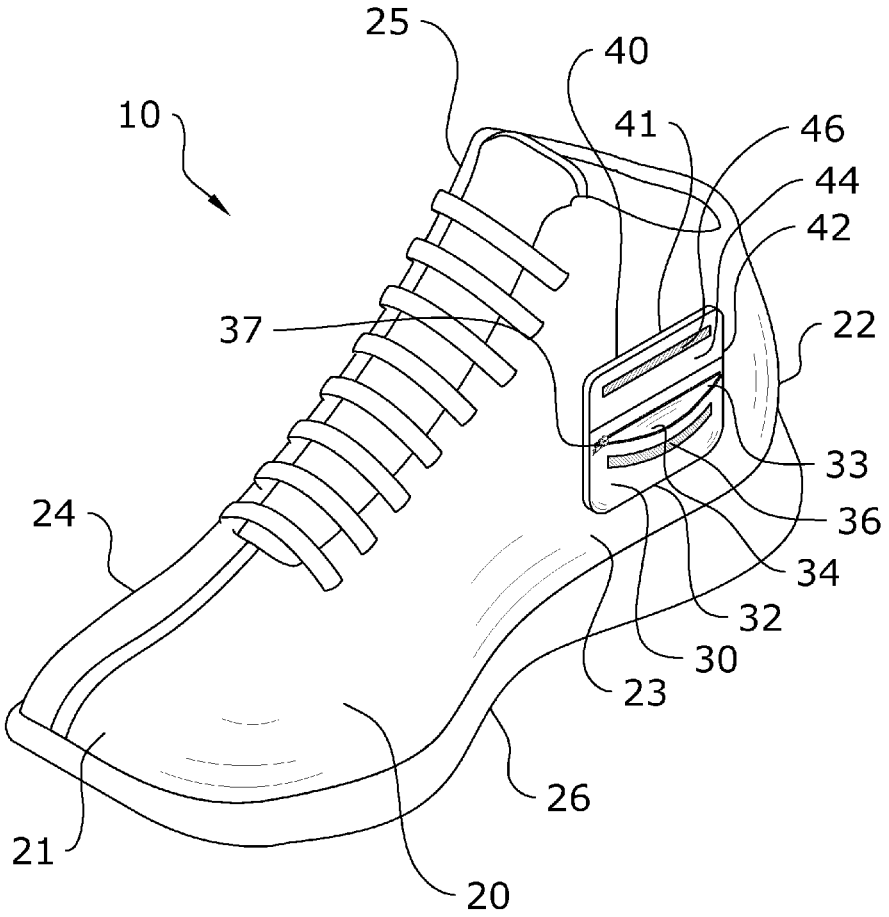
FIG. 3 is an upper perspective view of the present invention with the flap opened and the pocket compartment exposed incorporated with a first type of footwear.
Figure 4:
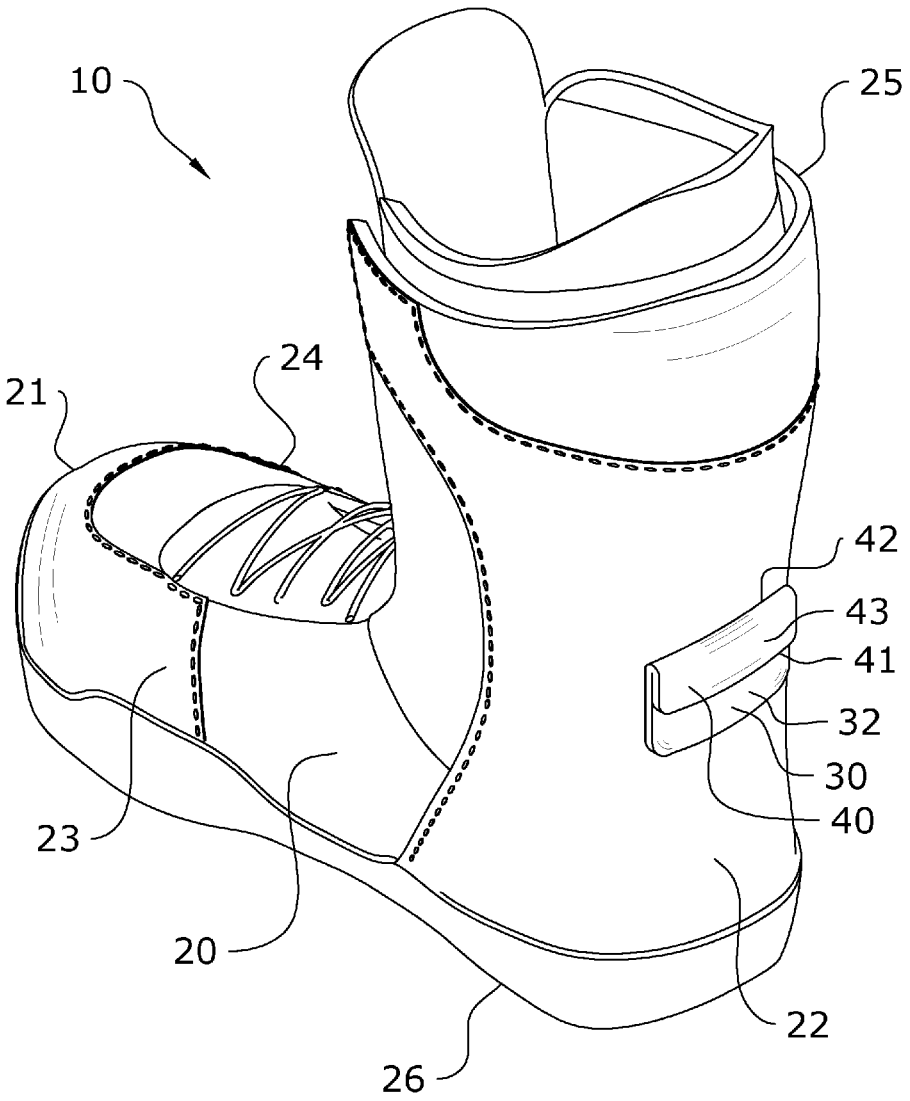
FIG. 4 is an upper perspective view of an alternate placement of the present invention on a second type of footwear.
Figure 5:
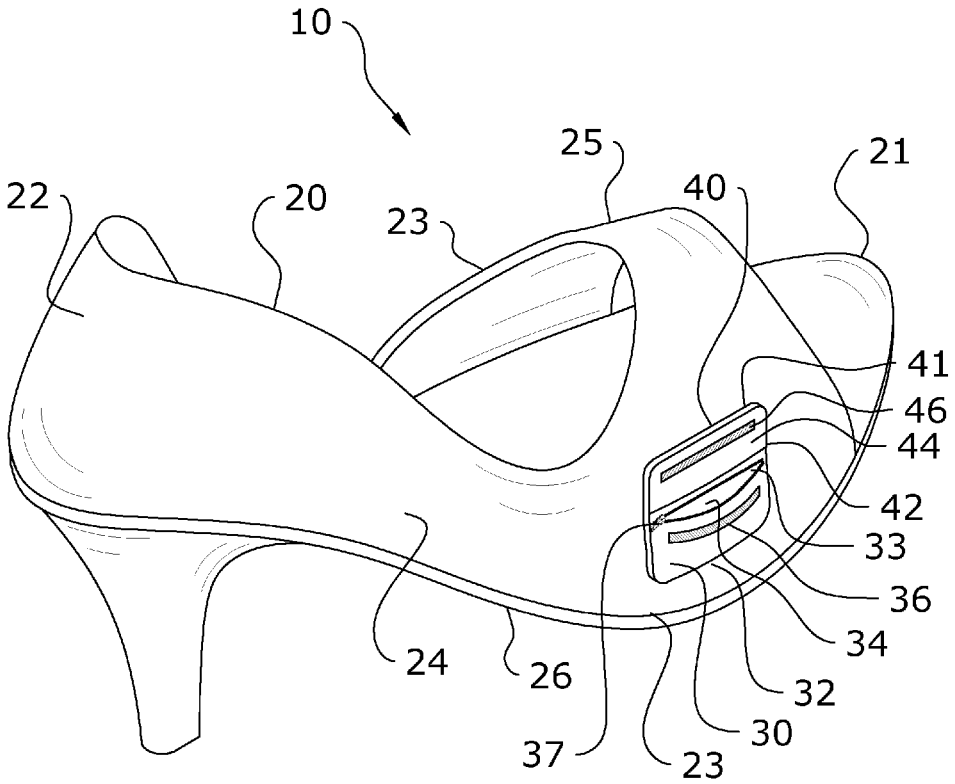
FIG. 5 is an upper perspective view of an alternate placement of the present invention on a third type of footwear.

It should be appreciated that the present invention may be utilized with any type of footwear 20. The figures illustrate exemplary embodiments of the present invention in a non-limiting manner. By way of example, FIGS. 1-3 illustrate an embodiment of the present invention in use with high-top sneakers. FIG. 4 illustrates an embodiment of the present invention in use with a boot, such as would be used in skiing, snowboarding, or traversing areas impacted by heavy snow. FIG. 5 illustrates an embodiment of the present invention in use with a woman's shoe. The present invention should not be construed as being limited to any particular type of footwear 20.

Generally, the footwear 20 will include a front portion 21, a rear portion 22, a first side 23, a second side 24, an upper portion 25, and a bottom portion 26. The bottom portion 26 will generally comprise a sole or another structure on the footwear 20 which regularly impacts the ground. It should be appreciated that the present invention may be utilized on any portion 21, 22, 23, 24, 25, 26 of the footwear 20, depending on the design of the footwear 20 and the application by the user. Thus, the present invention should not be unnecessarily construed as being limited to any particular placement of the pocket 30 on the footwear 20.

C. Pocket.

As shown throughout the figures, the present invention comprises a water-proof, leak-proof pocket 30 which is secured to footwear 20 such as a shoe or boot. As noted above, the placement of the pocket 30 may vary in different embodiments. FIGS. 1-3 illustrate a pocket 30 positioned on a first side 23 of footwear 20 adjacent to its rear portion 22. FIG. 4 illustrates a pocket 30 positioned on the rear portion 22 of footwear 20. FIG. 5 illustrates a pocket 30 positioned on a first side 23 of footwear 20 adjacent to its front portion 21.

The pocket 20 may be secured to the footwear 20 or, in some embodiments, may be integrally formed therewith. As shown in the figures, the pocket 20 includes a main body 32 defining a cavity 34, a closure member 37 for enclosing the cavity 34, and a flap 40 which may be selectively positioned over the closure member 37. In some embodiments, the flap 40 may be omitted. The pocket 20 is preferably comprised of a water-proof and leak-proof material, such as plastics, vinyls, and the like.

The overall shape of the pocket 30 may vary in different embodiments. The figures illustrate a substantially rectangular pocket 30 design for illustrative purposes. The pocket 30 could in some embodiments comprise different shapes, sizes, and configurations to accommodate different types of footwear 20 and/or different types of objects to be stored therein. By way of example, the pocket 30 could be round, triangular, polygonal, or comprised of irregular shapes.

The main body 32 of the pocket 30 is either secured to or integrally formed with the footwear 20. The main body 32 includes an opening 33 which provides access to a cavity 34. The cavity 34 may be fully formed within the main body 32 or may be defined by both the man body 32 of the pocket 30 and the outer surface of the footwear 20. The main body 32 may be sewn onto the footwear 20 or otherwise secured thereto by various methods known in the art for securing a pocket 30 to an object such as footwear 20. As mentioned previously, the main body 32 may also be partially or fully integrally formed with the footwear 20 itself.

As best shown in FIGS. 2 and 3, the opening 33 of the pocket 30 may include a closure member 37 for closing and sealing the cavity 34 from leaks or other incursions by fluids. In a preferred embodiment, the closure member 37 may comprise a zipper as shown in the figures. The closure member 37 may be lined with a sealant to improve the sealing properties of the present invention and further prevent water leakage into the cavity 34. Various other closures may be utilized other than zippers so long as the cavity 34 is protected from water leakage when the closure member 37 is in its closed state.

The pocket 30 may include a flap 40 which is selectively positioned to cover the opening 33 and closure member 37 as best shown in FIGS. 1 and 2. The flap 40 will generally extend above the main body 32 of the pocket 30 and be selectively folded over to partially or wholly cover the main body 32. When closed, the flap 40 will fully cover the opening 33 and closure member 37 to provide additional protection from water leaks.

The flap 40 will preferably be comprised of a water-proof material. The flap 40 may be comprised of the same material as the main body 32 of the pocket 30 or may be comprised of a different material. The flap 40 may be secured to the main body 32 of the pocket 30 or may be secured directly to the footwear 30 in a manner which allows the flap 40 to be selectively extended over the main body 32 of the pocket 30. In other embodiments, the flap 40 may be integrally formed with the main body 32 of the pocket 30, simply including a creased edge which allows the flap 40 to be selectively lifted to expose the opening 33 or lowered to cover the opening 33.

The shape, size, and configuration of the flap 40 may vary. As shown in the figures, the flap 40 includes an upper end 41, a lower end 42, an outer surface 43, and an inner surface 44. The lower end 42 of the flap 40 is generally positioned adjacent to the upper end of the main body 32 of the pocket 30 as shown in the figures. The upper end 41 of the flap 40 may be selectively lowered so that the flap 40 partially or fully covers the main body 32 of the pocket 30. When so lowered, the outer surface 43 of the flap 40 will be exposed and the inner surface 44 of the flap 40 will rest against the main body 32 of the pocket 30, such as shown in FIG. 6.

Figure 6:
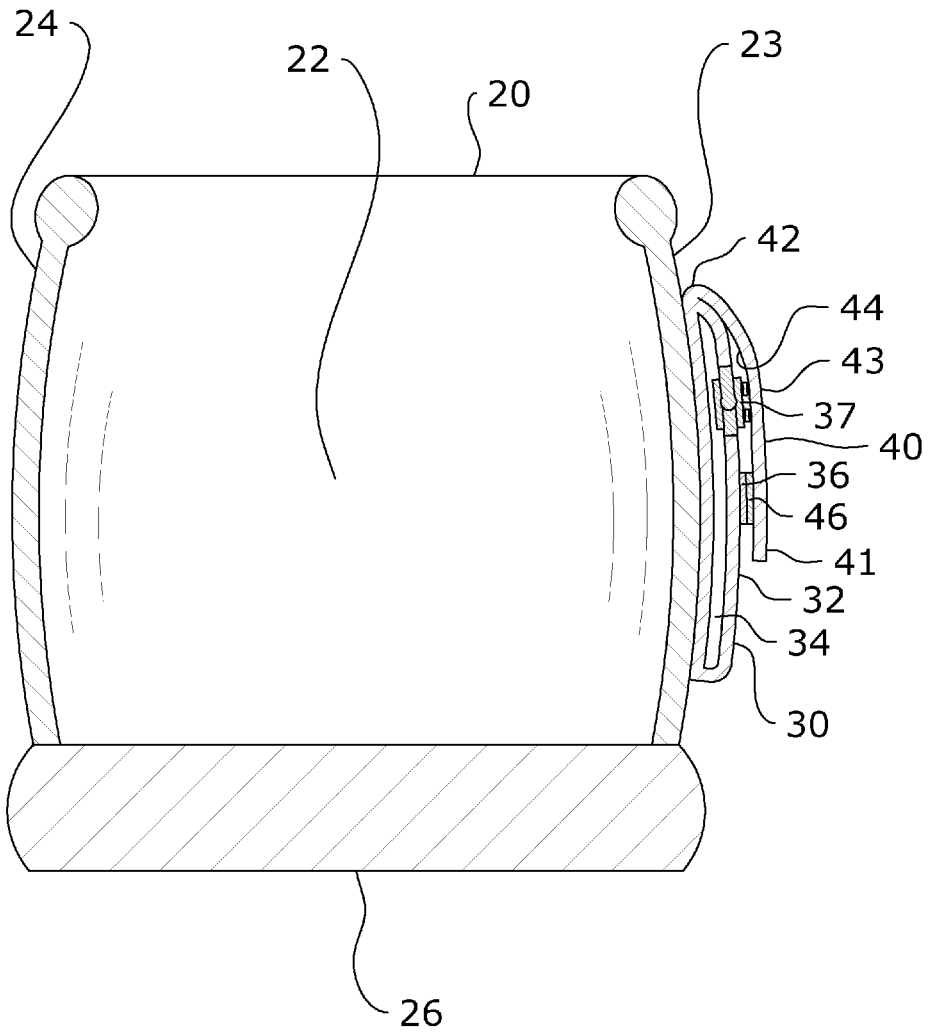
FIG. 6 is a rear sectional view of the present invention.

To removably retain the flap 40 in its closed position, the main body 32 of the pocket 30 and/or the flap 40 may include one or more connectors 36, 46 which are adapted to selectively and removably engage with each other to removably retain the flap 40 against the pocket 30 in a configuration best shown in FIGS. 1 and 6. In a preferred embodiment, a first connector 36 is positioned on the main body 32 of the pocket 30 beneath the opening 33 and a second connector 46 is positioned on the inner surface 44 of the flap 40 adjacent to its upper end 41. While the figures illustrate hook-and-loop fasteners as comprising the connectors 36, 46, it should be appreciated that other connectors 36, 46 may be utilized to secure the flap 40 over the pocket 30.

D. Operation of Preferred Embodiment.

In use, the flap 40 is first lifted off the main body 32 of the pocket 30. The closure member 37 may then be disengaged (such as by unzipping) to expose the opening 33 leading to the cavity 34. An object such as a key fob, cell phone, or the like may then be positioned within the cavity 34 of the pocket 30. The closure member 36 is then closed (such as by zipping) and the flap 40 lowered over the main body 32 and secured thereto by use of the connectors 36, 46. The object is now protected from water damage.

When needed, the flap 40 may be lifted off the main body 32 to expose the closure member 37. The closure member 37 may be disengaged to expose the opening 33 and cavity 34. The object may then be removed from the pocket 30, the closure member 37 closed, and the flap 40 repositioned down over the main body 32 to await further use.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A waterproof footwear pocket, comprising:
a main body comprised of a waterproof material;
a cavity formed within said main body;
an opening leading to a said cavity of said main body;
a flap adapted to be removably secured to said main body to selectively cover said opening;
a first closure member adapted to selectively open or close said opening; and
a second closure member selectively opening and closing the flap over the first closure member, wherein
the waterproof footwear pocket is formed as an integral Y-shape with an end of the leg of the Y-shape and a first arm of the Y-shape forming a generally C-shaped element, with ends of the C-shaped element joined by the first closure member, the flap being formed from a second arm of the Y-shape, the second arm being longer than the first arm.

2. The waterproof footwear pocket of claim 1, wherein said flap is extends from an upper portion of the C-shaped element.

3. The waterproof footwear pocket of claim 1, further comprising a first connector on said main body and a second connector on an inner surface of said flap.

4. The waterproof footwear pocket of claim 3, wherein said first connector and said second connector comprise hook-and-loop fasteners.

5. The waterproof footwear pocket of claim 1, wherein said first closure member is comprised of a zipper.

6. The waterproof footwear pocket of claim 1, further comprising a sealant applied to said closure member.

7. The waterproof footwear pocket of claim 1, wherein said waterproof material is comprised of plastic.

8. The waterproof footwear pocket of claim 1, wherein a base of the main body is attached to an outer surface of footwear.

9. The waterproof footwear pocket of claim 1, wherein a base of the main body forms a portion of an outer surface of footwear.

10. A waterproof footwear pocket system, comprising:
a footwear, wherein said footwear includes an outer surface;
a pocket including a main body comprised of a waterproof material;
an opening leading to a cavity of said main body;
a flap removably secured to said main body to selectively cover said opening; and
a first closure member adapted to selectively open or close said opening; and
a second closure member selectively opening and closing the flap over the first closure member, wherein
the pocket is formed as an integral Y-shape with an end of the leg of the Y-shape and a first arm of the Y-shape forming a generally C-shaped element, with ends of the C-shaped element joined by the first closure member, the flap being formed from a second arm of the Y-shape, the second arm being longer than the first arm.

11. The waterproof footwear pocket system of claim 10, further comprising a first connector on said main body and a second connector on an inner surface of said flap.

12. The waterproof footwear pocket system of claim 11, wherein said first connector and said second connector comprise hook-and-loop fasteners.

13. The waterproof footwear pocket system of claim 10, wherein said first closure member is comprised of a zipper.

14. The waterproof footwear pocket system of claim 10, further comprising a sealant applied to said closure member.

15. The waterproof footwear pocket system of claim 10, wherein said waterproof material is comprised of vinyl.

16. The waterproof footwear pocket system of claim 10, wherein said pocket is positioned on a first side of said footwear.

17. The waterproof footwear pocket system of claim 10, wherein said pocket is positioned on a rear end of said footwear.

18. The waterproof footwear pocket of claim 10, wherein a base of the main body is attached to the outer surface of the footwear.

19. The waterproof footwear pocket of claim 10, wherein a base of the main body forms a portion of the outer surface of the footwear.

* * * * *